US011538410B2

(12) United States Patent
Liu et al.

(10) Patent No.: US 11,538,410 B2
(45) Date of Patent: Dec. 27, 2022

(54) PIXEL CIRCUIT, DRIVING METHOD THEREOF AND ELECTRONIC DEVICE

(71) Applicant: BOE Technology Group Co., Ltd., Beijing (CN)

(72) Inventors: Dongni Liu, Beijing (CN); Minghua Xuan, Beijing (CN); Li Xiao, Beijing (CN); Haoliang Zheng, Beijing (CN); Liang Chen, Beijing (CN); Jiao Zhao, Beijing (CN); Seungwoo Han, Beijing (CN); Hao Chen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/407,147

(22) Filed: Aug. 19, 2021

(65) Prior Publication Data

US 2022/0130331 A1 Apr. 28, 2022

(30) Foreign Application Priority Data

Oct. 26, 2020 (CN) ..... 202011157927.8

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2310/0278* (2013.01); *G09G 2310/062* (2013.01)

(58) Field of Classification Search
CPC ..... H01L 27/32–3279
See application file for complete search history.

(56) References Cited

U.S. PATENT DOCUMENTS

2007/0103406 A1* 5/2007 Kim ..... G09G 3/3233 345/76
2020/0203461 A1* 6/2020 Chen ..... G09G 3/3258
2021/0201794 A1* 7/2021 Xu ..... G09G 3/3291

* cited by examiner

*Primary Examiner* — Sanjiv D. Patel
(74) *Attorney, Agent, or Firm* — IPRO, PLLC

(57) ABSTRACT

A pixel circuit, a driving method thereof and a light emitting device, and relates to the technical field of display. The pixel circuit comprises driving sub-circuit comprising a control terminal, first terminal and a second terminal, driving sub-circuit being configured to control driving signal flowing through the first terminal and second terminal according to signal of control terminal; first capacitor comprising first pole and second pole coupled to control terminal of driving sub-circuit; first data writing sub-circuit configured to write first initialization signal to first pole of first capacitor in response to first scanning signal, write first data signal into driving sub-circuit in response to first scanning signal, so that signal of control signal of driving sub-circuit changes with first data signal; second data writing sub-circuit configured to write second data signal to first pole of first capacitor in response to second scanning signal.

16 Claims, 11 Drawing Sheets

PIXEL CIRCUIT, DRIVING METHOD THEREOF AND ELECTRONIC DEVICE

The present application claims the priority of the Chinese patent application filed on Oct. 26, 2020 before the Chinese Patent Office with the disclosure number of 202011157927.8 and the title of "Pixel Circuit, Driving Method thereof and Electronic Device", which is incorporated herein in its entirety by reference.

TECHNICAL FIELD

The disclosure relates to the technical field of display, in particular to a pixel circuit, a driving method thereof and electronic device.

BACKGROUND

Light emitting components (e.g., LED, mini LED and microLED) are applied to light emitting devices, which may be panels using OLED, QLED, mini LED and microLED as display pixels.

SUMMARY

The embodiments of the disclosure provide a pixel circuit, a driving method thereof and electronic device. The embodiments of the disclosure adopt the following technical solution:

In a first aspect, a pixel circuit is provided, which is used for providing a driving signal to an element to be driven. The pixel circuit comprises a driving sub-circuit comprising a control terminal, a first terminal and a second terminal, the driving sub-circuit being configured to control a driving signal flowing through the first terminal and the second terminal according to a signal of the control terminal; a first capacitor comprising a first pole and a second pole coupled to the control terminal of the driving sub-circuit; a first data writing sub-circuit configured to write a first initialization signal to the first pole of the first capacitor in response to a first scanning signal, and write a first data signal into the driving sub-circuit in response to the first scanning signal, so that the signal of the control signal of the driving sub-circuit changes with the first data signal; and a second data writing sub-circuit configured to write a second data signal to the first pole of the first capacitor in response to a second scanning signal, so that the signal of the control terminal of the driving sub-circuit jumps.

Optionally, the first data writing sub-circuit is coupled to the control terminal of the driving sub-circuit and configured to write the first data signal to the control terminal of the driving sub-circuit.

Optionally, the driving sub-circuit comprises a second capacitor and a driving transistor;

the second capacitor is coupled between the control terminal of the driving sub-circuit and a first terminal of the element to be driven; and a grid of the driving transistor is coupled to the control signal of the driving sub-circuit, a first pole of the driving transistor is coupled to the first terminal of the driving sub-circuit, and a second pole of the driving transistor is coupled to the second terminal of the driving sub-circuit.

Optionally, the first data writing sub-circuit is coupled to the second terminal of the driving sub-circuit and configured to write the first data signal to the second terminal of the driving sub-circuit; and the driving sub-circuit is further configured to connect the first terminal of the driving sub-circuit with the control terminal of the driving sub-circuit in response to the first scanning signal so as to write a compensated first data signal to the control terminal of the driving sub-circuit.

Optionally, the driving sub-circuit further comprises a first transistor; and a grid of the first transistor is coupled to a first scanning terminal providing the first scanning signal, a first pole is coupled to the first terminal of the driving sub-circuit, and a second pole is coupled to the control terminal of the driving sub-circuit.

Optionally, a first reset sub-circuit configured to reset the control terminal of the driving sub-circuit in response to a third scanning signal.

Optionally, the first reset sub-circuit comprises a second transistor; and a grid of the second transistor is coupled to a third scanning terminal providing the third scanning signal, a second pole is coupled to the control terminal of the driving sub-circuit, and a first pole is coupled to an initial signal terminal.

Optionally, the first data writing sub-circuit comprises a third transistor and a fourth transistor;

a grid of the third transistor is coupled to a first scanning terminal providing the first scanning signal, a first pole is coupled to a first signal terminal, and a second pole is coupled to the first pole of the first capacitor;

a grid of the fourth transistor is coupled to the first scanning terminal providing the first scanning signal, a first pole is coupled to a first data terminal providing the first data signal, and a second pole is coupled to the control terminal of the driving sub-circuit.

Optionally, the first data writing sub-circuit comprises a third transistor and a fifth transistor;

a grid of the third transistor is coupled to a first scanning terminal providing the first scanning signal, a first pole is coupled to a first signal terminal, and a second pole is coupled to the first pole of the first capacitor;

a grid of the fifth transistor is coupled to the first scanning terminal providing the first scanning signal, a first pole is coupled to the first data terminal providing the first data signal, a second pole is coupled to the second terminal of the driving sub-circuit.

Optionally, the second data writing sub-circuit comprises a sixth transistor; and a grid of the sixth transistor is coupled to a second scanning terminal providing the second scanning signal, a first pole is coupled to a second data terminal providing the second data signal, and a second pole is coupled to the first pole of the first capacitor.

Optionally, a second reset sub-circuit configured to reset a second terminal of the element to be driven in response to a third scanning signal.

Optionally, the second reset sub-circuit comprises a seventh transistor; and a grid of the seventh transistor is coupled to a third scanning terminal providing the third scanning signal, a first pole is coupled to the initial signal terminal, and a second pole is coupled to a second terminal of the element to be driven.

Optionally, a light emission control sub-circuit configured to apply a voltage of a first working voltage terminal to the first terminal of the driving sub-circuit in response to a light emission control signal to control a driving signal applied to the element to be driven.

Optionally, the light emission control sub-circuit comprises an eighth transistor and/or a ninth transistor;

a grid of the eighth transistor is coupled to a light emission control terminal providing the light emission control signal, a first pole is coupled to a second terminal of the element to be driven, and a second pole is coupled to the first terminal of the driving sub-circuit; and a grid of the ninth transistor is coupled to the light emission control terminal providing the light emission control signal, a first pole is coupled to the second terminal of the driving sub-circuit, and a second pole is coupled to a second working voltage terminal providing a second working voltage.

In a second aspect, an embodiment of the disclosure provides a light emitting device, which comprises the pixel circuit as described in the first aspect and a light emitting component coupled to the pixel circuit.

BRIEF DESCRIPTION OF THE DRAWINGS

In order to more clearly explain the technical solution in the embodiments of the disclosure, the following will briefly introduce the drawings needed in the description of the embodiments or the prior art. Obviously, the drawings in the following description are only some embodiments of the disclosure. For those of ordinary skill in the art, other drawings may be obtained according to the provided drawings without paying creative labor.

DETAILED DESCRIPTION

Figure 1:
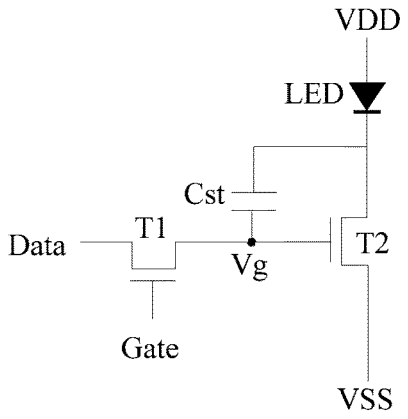
FIG. 1 is a pixel circuit provided by the related art.

Hereinafter, the technical solution in the embodiments of the disclosure will be described clearly and completely with reference to the drawings in the embodiments of the disclosure. Obviously, the described embodiments are only part of the embodiments of the disclosure, not all of the embodiments. Based on the embodiments of the disclosure, all other embodiments obtained by those of ordinary skill in the art without creative labor are within the scope of the disclosure.

In the description of the disclosure, it should be noted that the orientation or position relationship indicated by the terms "centric", "upper", "lower", "front", "rear", "left", "right", "vertical", "horizontal", "top", "bottom", "inner" and "outer" are based on the orientation or position relationship shown in the drawings, only for convenience of describing the disclosure and simplifying the description, and do not indicate or imply that the indicated device or element must have a specific orientation, or be constructed and operate in a specific orientation, and therefore may not be understood as a limitation of the disclosure.

Unless otherwise specified in the context, throughout the specification and claims, the term "comprise" and its other forms such as the third person singular form "comprises" and the present participle form "comprising" are interpreted as open and inclusive, that is, "including, but not limited to". In the description of the specification, the terms "one embodiment", "some embodiments", "exemplary embodiments", "example", "specific example" or "some examples", etc., are intended to indicate that specific features, structures, materials or characteristics related to this embodiment or example are included in at least one embodiment or example of the disclosure. Schematic representations of the above terms do not necessarily refer to the same embodiment or example. In addition, the specific features, structures, materials or characteristics described may be included in any one or more embodiments or examples in any suitable manner.

Hereinafter, the terms "first" and "second" are only used for descriptive purposes, and may not be understood as indicating or implying relative importance or implicitly indicating the number of indicated technical features. Therefore, the features defined with "first" and "second" may include one or more of the features explicitly or implicitly. In the description of the embodiments of the disclosure, unless otherwise specified, the meaning of "a plurality of" is two or more.

In describing some embodiments, expressions like "coupled" and "connected" and their derivatives may be used. For example, the term "connected" may be used when describing some embodiments to indicate that two or more components have direct physical or electrical contact. For another example, the term "coupled" may be used when describing some embodiments to indicate that two or more components have direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The expression "at least one of A, B and C" has the same meaning as the expression "at least one of A, B or C" and includes the following combinations of A, B and C: only A, only B, only C, the combination of A and B, the combination of A and C, the combination of B and C, and the combination of A, B and C.

The expression "A and/or B" includes the following three combinations: only A, only B, and the combination of A and B.

"Multiple" means at least two.

The phrase "used to" or "configured to" used herein has an open and inclusive meaning, which does not exclude devices used to or configured to perform additional tasks or steps.

In the related art, a display panel comprising a current-driven element comprises a light emitting element LED and a pixel circuit driving the light emitting element LED. As shown in FIG. 1, the pixel circuit may comprise two thin film transistors and one capacitor. On this basis, with reference to the signal timing diagram shown in FIG. 2, the working principle of the pixel circuit shown in FIG. 1 is illustrated in detail. The working principle of the pixel circuit may be divided into a data writing stage and a light emitting stage. Each stage will be described below.

Figure 2:
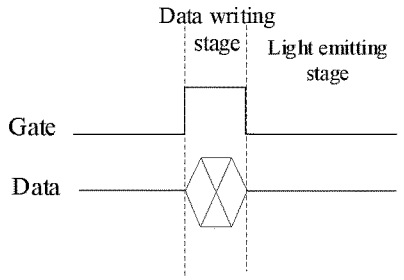
FIG. 2 is a timing diagram of a pixel circuit provided by the related art.

In the data writing stage, as shown in FIG. 2, because a scanning signal from a scanning signal terminal Gate is input with a low level signal, a transistor T1 is turned on, so that a data signal from a data terminal is written into a driving transistor T2, at the same time, the voltage at a point g is maintained under the action of the capacitor Cst, and at this point, the potential Vg of the point g is equal to Vdata.

In the light emitting stage, the driving transistor T2 is turned on to make a light emitting component L emit light, and at this point, the current flowing through the light emitting component L is $I=K*(V_G-V_S)^2$.

In the related art, due to the influence of cost and process, when the pixel circuit as shown in FIG. 1 is used to provide uA and mA-level large current to the light emitting component, an adjustment range of a data voltage required for large current display may not be provided to the display panel.

In order to solve the above problems, an embodiment of the disclosure provides electronic device, which comprises an element to be driven and a pixel circuit for providing a driving signal to the element to be driven. The element to be driven may be a light emitting component.

In some embodiments, the element to be driven is a light emitting component L, which may be a current-driven light emitting component, such as a light emitting diode (LED), a micro light emitting diode (Micro LED), a mini light emitting diode (Mini LED), an organic light emitting diode (OLED) or a quantum dot light emitting diode, etc. Of course, these light emitting components L may also be voltage-driven light emitting components, which is not limited in this embodiment.

By way of example, the electronic device may be a light emitting device, and the light emitting device comprises a light emitting component and a pixel circuit for supplying an electrical signal to the light emitting component to drive the light emitting component to emit light. Of course, other parts may also be included, such as a control circuit for providing electrical signals to the pixel circuit, and the control circuit may comprise a printed circuit board and/or an integrated circuit electrically connected with a light emitting substrate.

In some embodiments, the light emitting device may be an illumination device, and in this case, the light emitting device is used as a light source to realize the illumination function. For example, the light emitting device may be a backlight module in a liquid crystal display device, used for interior or exterior lighting, or various signal lamps.

In other embodiments, the light emitting device may be a display device for displaying an image (i.e., a picture). In this case, the light emitting device may comprise a display or a product comprising a display. The display may be a flat panel display (FPD) or a micro display. Based on whether a user may see the scene on the back of the display, displays are divided into transparent displays and opaque displays. Based on whether the display may be bent or rolled up, displays are divided into flexible displays and ordinary displays (which may be called rigid displays). By way of example, products comprising displays may include computer monitors, televisions, billboards, laser printers with a display function, telephones, mobile phones, personal digital assistants (PDA), laptop computers, digital cameras, portable camcorders, viewfinders, vehicles, large-area walls, theater screens or stadium signs, etc.

Figure 3:
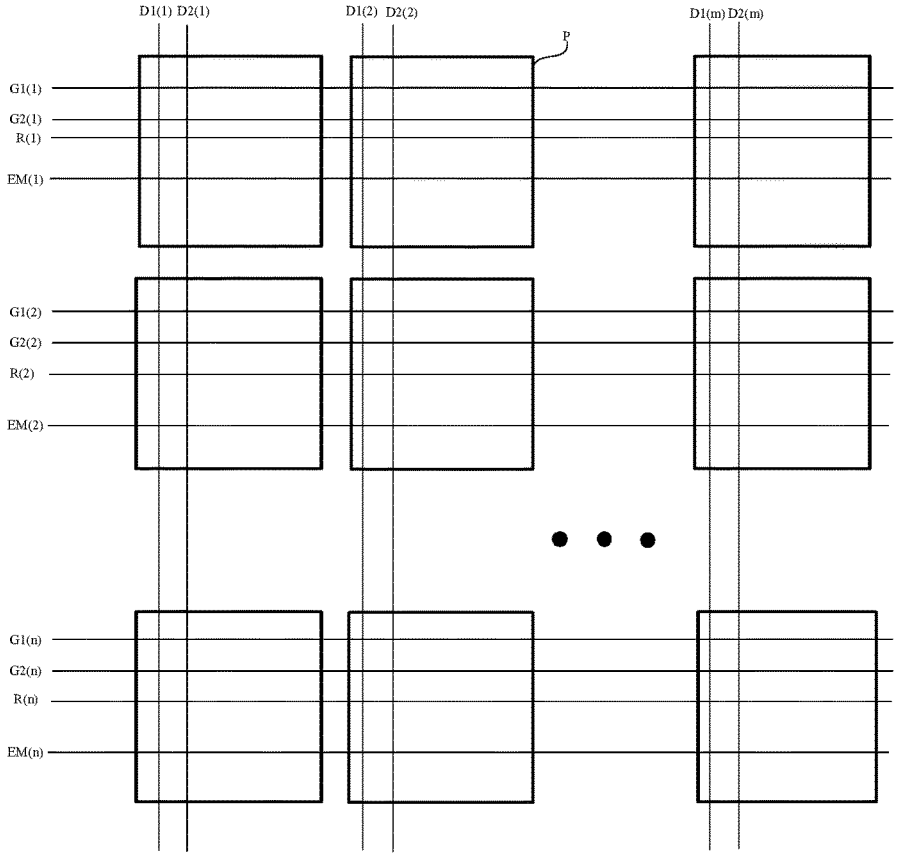
FIG. 3 is a diagram of a light emitting device provided by some embodiments of the disclosure.
Figure 4:
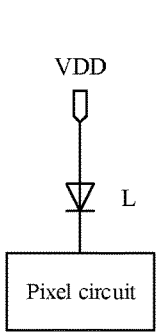
FIG. 4 is a schematic diagram of a sub-pixel provided by some embodiments of the disclosure.

The following description is based on the assumption that the light emitting device is a display device. As shown in FIG. 3, the light emitting device comprises a plurality of sub-pixels P. As shown in FIG. 4, at least one sub-pixel (for example, each sub-pixel) comprises a pixel circuit and an element to be driven L coupled thereto. The pixel circuits in each sub-pixel may be arranged into an array with n rows and m columns. The pixel circuit is used to drive the element to be driven L to work. A first terminal of the element to be driven L is coupled to a first working voltage terminal VDD, and a second terminal of the element to be driven L is coupled to the pixel circuit.

On this basis, as shown in FIG. 3, the light emitting device also comprises: a plurality of first scanning signal lines G1(1)-G1(*n*), a plurality of second scanning signal lines G2(1)-G2(*n*), a plurality of third scanning signal lines R(1)-R(n), a plurality of first data signal lines D1(1)-D1(*m*), a plurality of second data signal lines D2(1)-D2(*m*) and a plurality of light emission signal lines EM(1)-EM(n).

In this case, the pixel circuit may comprise a first scanning signal terminal Gate1, a second scanning signal terminal Gate2, a light emission control terminal EM, a first data terminal Data1, a second data terminal Data2 and a third scanning terminal RST. The plurality of first scanning signal lines provide first scanning signals for the first scanning signal terminal Gate1, the plurality of second scanning signal lines provide second scanning signals for the second scanning signal terminal Gate2, the plurality of light emission signal lines provide light emission signals for the light emission control terminal EM, the plurality of first data signal lines provide first data signals for the first data terminal Data1, the plurality of second data signal lines provide second data signals for the second data terminal Data2, and the plurality of third scanning signal lines provide reset signals for the third scanning terminal RST, thereby providing the first scanning signals, the second scanning signals, the light emission signals, the first data signals, the second data signals and the reset signals for the pixel circuit.

As shown in FIG. 3, the first scanning signal lines, the second scanning signal lines, the third scanning signal lines and the light emission signal lines are arranged in the row direction, and the first data signal lines and the second data signal lines are arranged in the column direction. The sub-pixels in the same row share the first scanning signal lines, the second scanning signal lines, the third scanning signal lines and the light emission signal lines, and the sub-pixels in the same column share the first data signal lines and the second data signal lines.

It should be noted that the arrangement of the plurality of signal lines included in the light emitting device described above and the wiring diagram of the light emitting device shown in FIG. 3 are only an example, and do not constitute a limitation on the structure of the light emitting device.

Figure 5:
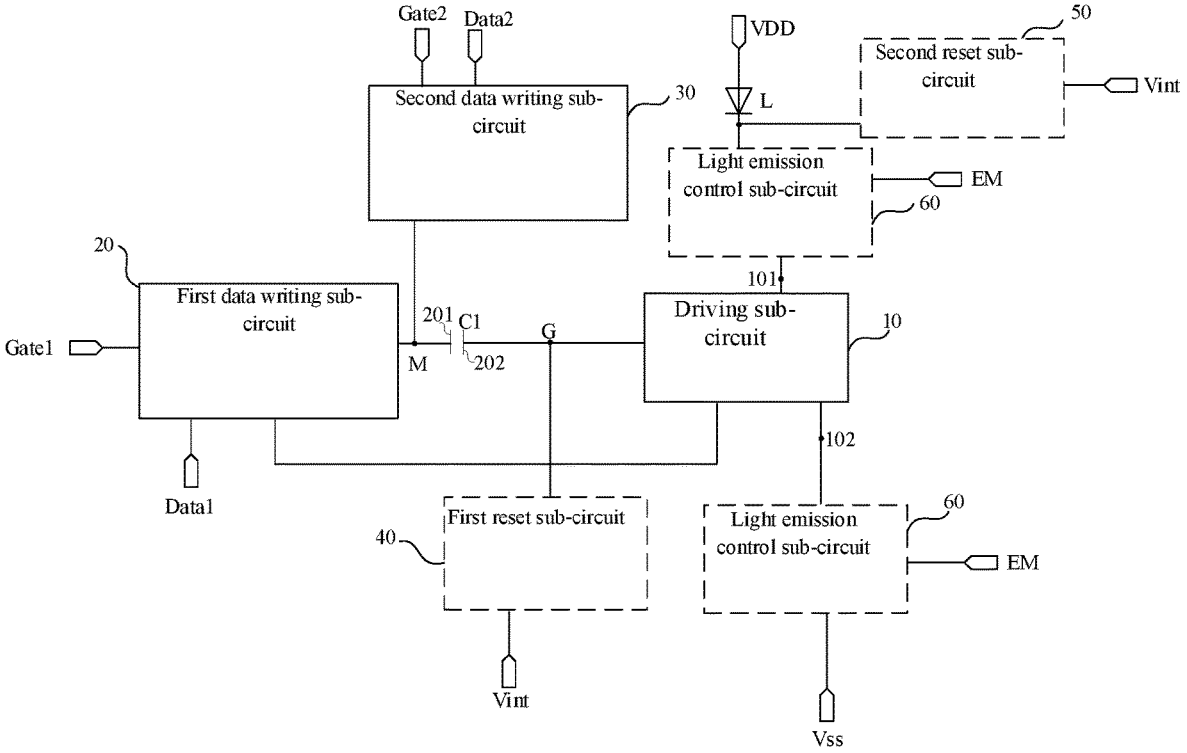
FIG. 5 is a module diagram of a pixel circuit provided by some embodiments of the disclosure.

An embodiment of the disclosure provides a pixel circuit for providing a driving signal to an element to be driven. As shown in FIG. 5, the pixel circuit comprises a driving sub-circuit 10, a first data writing sub-circuit 20, a second data writing sub-circuit 30 and a first capacitor C1. The driving sub-circuit 10 comprises a control terminal G, a first terminal 101 and a second terminal 102. The driving sub-circuit 10 is configured to control a driving signal flowing through the first terminal 101 and the second terminal 102 according to a signal of the control terminal G.

The first data writing sub-circuit 20 is configured to write a first initialization signal to a first pole 201 of the first capacitor C1 in response to a first scanning signal provided by a first scanning terminal Gate1, and to write a first data signal to the driving sub-circuit 10 in response to the first scanning signal, so that the signal of the control terminal G of the driving sub-circuit 10 changes with the first data signal.

The second data writing sub-circuit 30 is configured to write a second data signal to the first pole of the first capacitor C1 in response to a second scanning signal provided by a second scanning terminal Gate2, so that the signal of the control terminal G of the driving sub-circuit 10 jumps.

On this basis, the first data signal (e.g., data voltage) may be written into the first pole of the first capacitor C1 and the driving sub-circuit 10 through the first data writing sub-circuit 20, and the second data signal may be written into the first pole of the first capacitor C1 through the second data writing sub-circuit 30. In this way, according to the voltage holding characteristic of the capacitor, the signal of the control terminal of the driving sub-circuit will jump. For example, the voltage of the control terminal of the driving sub-circuit is pulled up, so that a data voltage required by a larger current may be provided to the light emitting component L, and the display of corresponding brightness may be realized, thus improving the display effect.

Figure 6:
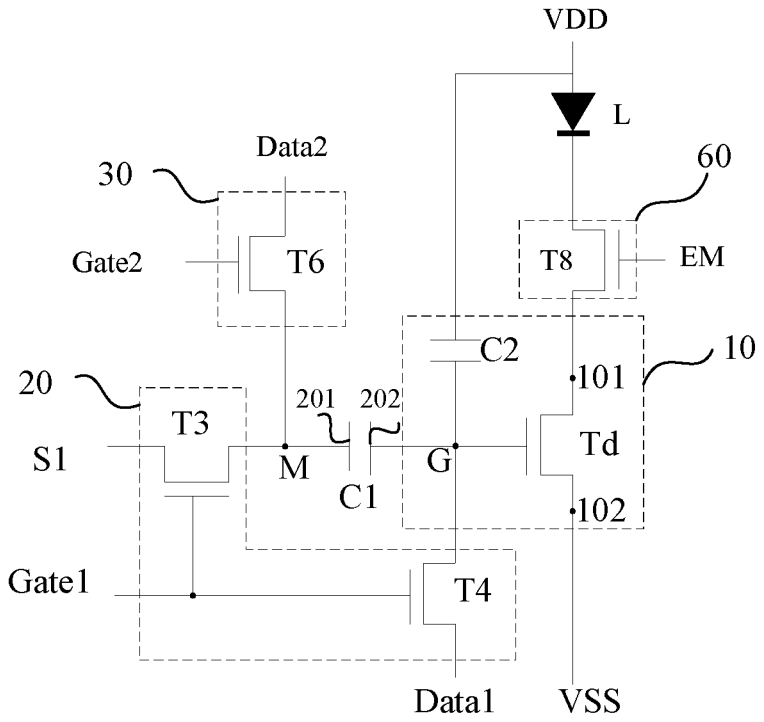
FIG. 6 is a diagram of a pixel circuit provided by some embodiments of the disclosure.

In some embodiments, as shown in FIG. 6, the driving sub-circuit 10 comprises a second capacitor C2 and a driving transistor Td.

The second capacitor C2 is coupled between the control terminal G of the driving sub-circuit and a first terminal of the element to be driven L. A grid of the driving transistor Td is coupled to the control terminal G of the driving sub-circuit, a first pole of the driving transistor Td is coupled to the first terminal 101 of the driving sub-circuit 10, and a second pole of the driving transistor Td is coupled to the second terminal 102 of the driving sub-circuit 10.

It should be noted that the first terminal of the element to be driven may be an anode of the light emitting component L, and a second terminal of the element to be driven may be a cathode of the light emitting component L. In some embodiments, as shown in FIG. 6, the first data writing sub-circuit 20 is coupled to the control terminal G of the driving sub-circuit 10, the first pole 201 of the first capacitor C1, a first signal terminal S1, a first data terminal Data1 and the first scanning terminal Gate1. The first signal terminal S1 provides the first initialization signal, the first data terminal Data1 provides the first data signal, and the first scanning terminal Gate1 provides the first scanning signal.

Specifically, as shown in FIG. 6, the first data writing sub-circuit 20 comprises a third transistor T3 and a fourth transistor T4.

A grid of the third transistor T3 is coupled to the first scanning terminal Gate1 providing the first scanning signal, a first pole is coupled to the first signal terminal S1, and a second pole is coupled to the first pole 201 of the first capacitor C1. After T3 is turned on, the first initialization signal provided by the first signal terminal S1 may be written into the first pole 201 of the first capacitor C1.

A grid of the fourth transistor T4 is coupled to the first scanning terminal Gate1 providing the first scanning signal, a first pole is coupled to the first data terminal Data1 providing the first data signal, and a second pole is coupled to the control terminal G of the driving sub-circuit. After T4 is turned on, the first data signal provided by the first data terminal Data1 may be written into the control terminal G of the driving sub-circuit 10.

In some embodiments, as shown in FIG. 6, the second data writing sub-circuit 30 comprises a sixth transistor T6.

A grid of the sixth transistor T6 is coupled to the second scanning terminal Gate2 providing the second scanning signal, a first pole is coupled to the second data terminal Data2 providing the second data signal, and a second pole is coupled to the first pole 201 of the first capacitor C1. After T6 is turned on, the second data signal provided by the second data terminal Data2 may be written into the first pole 201 of the first capacitor C1.

In some embodiments, as shown in FIG. 5, the pixel circuit further comprises a light emission control sub-circuit 60 coupled to the second terminal of the element to be driven L and the first terminal 101 of the driving sub-circuit 10 and configured to apply a voltage provided by a first working voltage terminal VDD to the first terminal 101 of the driving sub-circuit 10 in response to a light emission control signal provided by a light emission control terminal EM to control the driving signal applied to the element to be driven L.

Specifically, as shown in FIG. 6, the light emission control sub-circuit comprises an eighth transistor T8, a grid of the eighth transistor T8 is coupled to the light emission control terminal EM providing the light emission control signal, a first pole is coupled to the second terminal of the element to be driven L, and a second pole is coupled to the first terminal 101 of the driving sub-circuit 10. After T8 is turned on, the voltage provided by the first working voltage terminal VDD may be written into the first terminal 101 of the driving sub-circuit 10.

It should be noted that the first electrodes of the above transistors may be drain electrodes and the second electrodes may be source electrodes, or the first electrodes may be source electrodes and the second electrodes may be drain electrodes, which is not limited by this embodiment.

In the circuit provided by the embodiment, the transistors are all assumed to be N-type transistors. It should be noted that this embodiment includes but is not limited to this. For example, one or more transistors in the circuit provided in this embodiment may also be P-type transistors, as long as the poles of the selected type of transistors are connected correspondingly with reference to the poles of the corresponding transistors in this embodiment, and the corresponding voltage terminals provide corresponding high voltages or low voltages.

Figure 7:
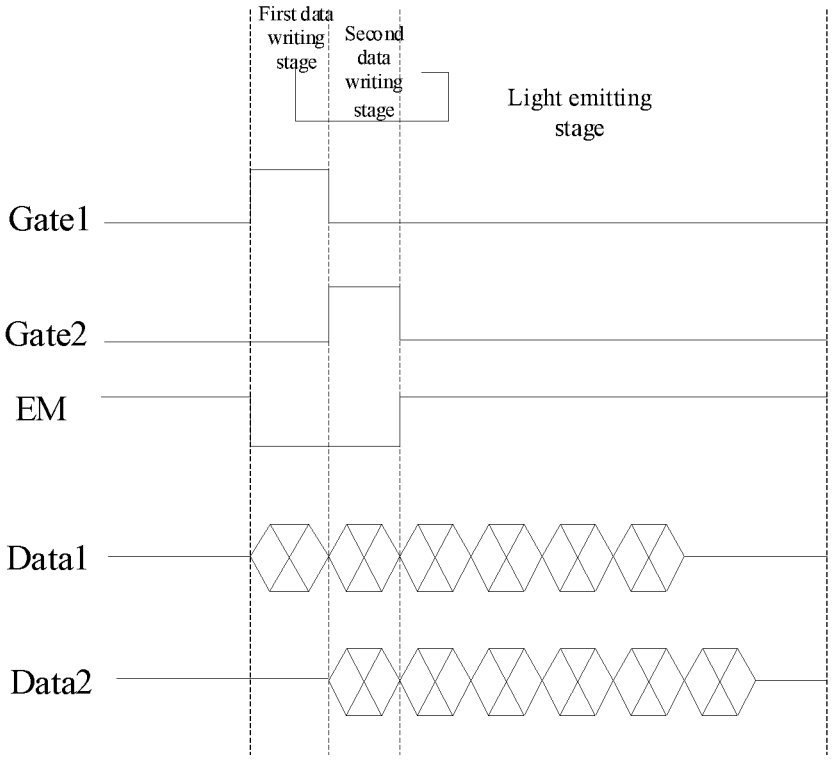
FIG. 7 is a timing diagram of a pixel circuit provided by some embodiments of the disclosure.

On this basis, with reference to the signal timing diagram shown in FIG. 7, the working principle of the pixel circuit shown in FIG. 6 is illustrated in detail. The working principle of the pixel circuit may be divided into a first data writing stage, a first data writing stage, a driving stage and a light emitting stage. Each stage will be described below.

In the first data writing stage, as shown in FIG. 7, because the first scanning signal from the first scanning terminal Gate1 is input with a high level signal, the third transistor T3 and the fourth transistor T4 are turned on, so that a first signal Vcom from the first signal terminal S1 is transmitted to the first pole 201 of the first capacitor C1, that is, the first signal Vcom is transmitted to a node M, and the first data signal from the first data terminal Data1 is transmitted to the control terminal G of the driving sub-circuit. At this point, an initial voltage at point M $V_M$=Vcom, and an initial voltage at point G $V_G=V_{Data1}$.

Figure 8A:
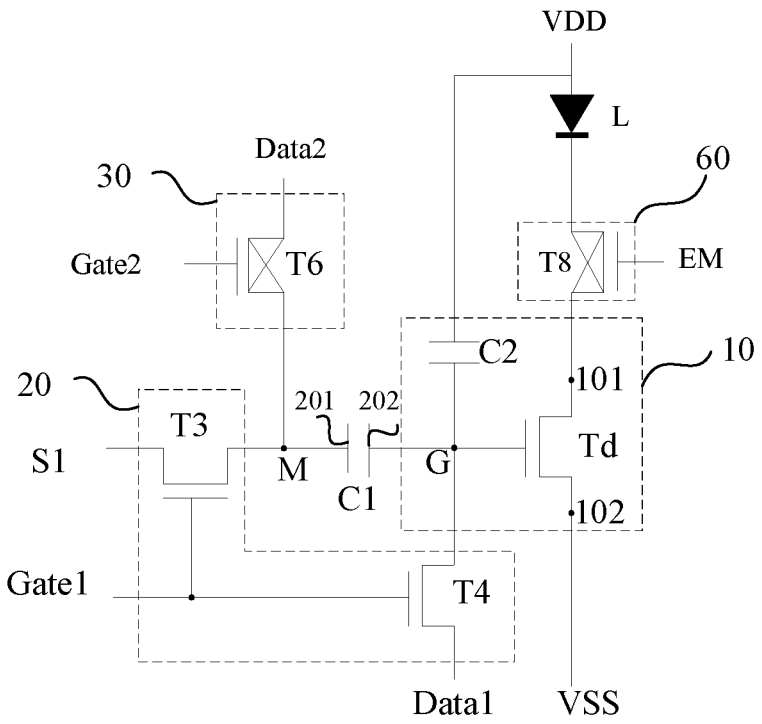
FIG. 8A is a stage diagram of a pixel circuit provided by some embodiments of the disclosure.

As shown in FIG. 8A, the first scanning terminal Gate1 is input with a high level signal, and at this point, the third transistor T3, the fourth transistor T4 and the driving transistor Td are all in an on state, and the sixth transistor T6 and the eighth transistor T8 are both in an off state.

In the second data writing stage, as shown in FIG. 7, since the second scanning signal from the second scanning terminal Gate2 is input with a high level signal, the sixth transistor T6 is turned on, so that the second data signal from the second data terminal Data2 is transmitted to the first pole 201 of the first capacitor C1, that is, the second data signal is transmitted to the node M. At this point, the voltage at point M $V_M=V_{Data2}$, and according to the voltage holding characteristic of the capacitor, it may be concluded that a voltage of the control terminal G of the driving sub-circuit after jumping satisfies $V_G=V_{Data1}+V_{Data2}-$Vcom.

Figure 8B:
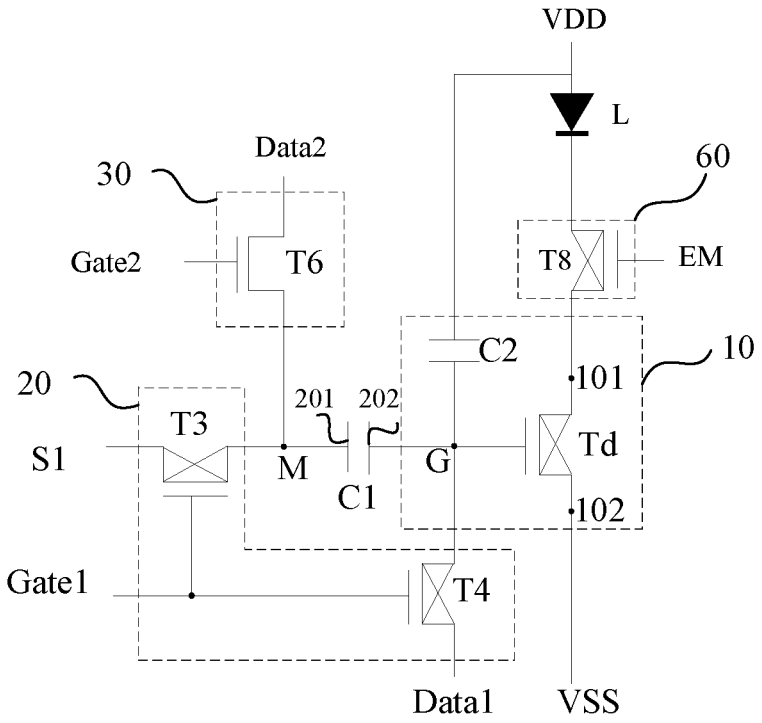
FIG. 8B is a stage diagram of another pixel circuit provided by some embodiments of the disclosure.

As shown in FIG. 8B, the second scanning terminal Gate2 is input with a high level signal. At this point, the sixth transistor T6 is in an on state, and the third transistor T3, the fourth transistor T4, the driving transistor Td and the eighth transistor T8 are all in an off state.

In the driving stage, the driving transistor Td controls the driving signal flowing through the first terminal 101 and the second terminal 102 for driving the element to be driven L to emit light according to the signal of the control terminal G. After the driving signal is applied to the element to be driven L, the element to be driven L may emit light.

In some embodiments, the driving signal for driving the element to be driven L to emit light may be either current or voltage, which is not limited in this embodiment.

The following description is based on the assumption that the driving signal driving the element to be driven L to emit light is current. The current driving the element to be driven L to emit light is $I=K*(V_G-V_S-V_{th})^2$, where $$K = \frac{1}{2} * \mu * Cox * \frac{W}{L},$$

μ is a migration rate of electrons, Cox is a gate oxide capacitance per unit area, $$\frac{W}{L}$$

is a width-length ratio of the driving transistor Td, and Vth is a threshold voltage.

$$V_{G'} = V_{Data1} + V_{Data2} - Vcom \quad \text{formula 1}$$

$$Vs = Vss \quad \text{formula 2}$$

where when Vcom=0, $V_{Data1}-V_{Data2}$, it may be calculated from the above formula 1 and formula 2 that the current flowing through the element to be driven L is $I=k*(2*V_{Data1}-Vss-V_{th})^2$.

In this embodiment, in the first data writing stage, an initial voltage at point M $V_M$=Vcom, and an initial voltage at point G $V_G=V_{Data1}$; in the second data writing stage, a signal at point M $V_M=V_{Data2}$; and according to the voltage holding characteristic of the capacitor, a voltage at point G after jumping satisfies $V_G=V_{Data1}+V_{Data2}-$Vcom, thus obtaining a formula of the current flowing through the element to be driven L. With reference to this current formula, the current supplied to the element to be driven L is related to a grid voltage of the driving transistor Td. In the pixel circuit provided in this embodiment, when the current I is supplied to the element to be driven L, the grid voltage of the driving transistor Td may be raised from $V_{data}$ to $2V_{data}$, and the magnitude of $V_{data}$ is related to the output capability of an integrated circuit (such as a printed circuit board or a programmable logic array) that supplies electrical signals to a display device. Therefore, with the pixel circuit provided in this embodiment, under the condition of using integrated circuits with the same output capability, a data voltage required by a larger current may be supplied to the element to be driven L, and the display of corresponding brightness may be realized, thus improving the display effect.

In the light emitting stage, as shown in FIG. 7, because the light emission control signal from the light emission control terminal EM inputs a high level signal, the eighth transistor T8 is turned on, so that the voltage from the first working voltage terminal VDD is applied to the first terminal 101 of the driving sub-circuit, and the driving sub-circuit 10 controls the driving signal flowing through the first terminal 101 and the second terminal 102 according to the signal of the control terminal G, thereby applying the driving signal to the element to be driven L, so that the element to be driven L emits light.

Figure 8C:
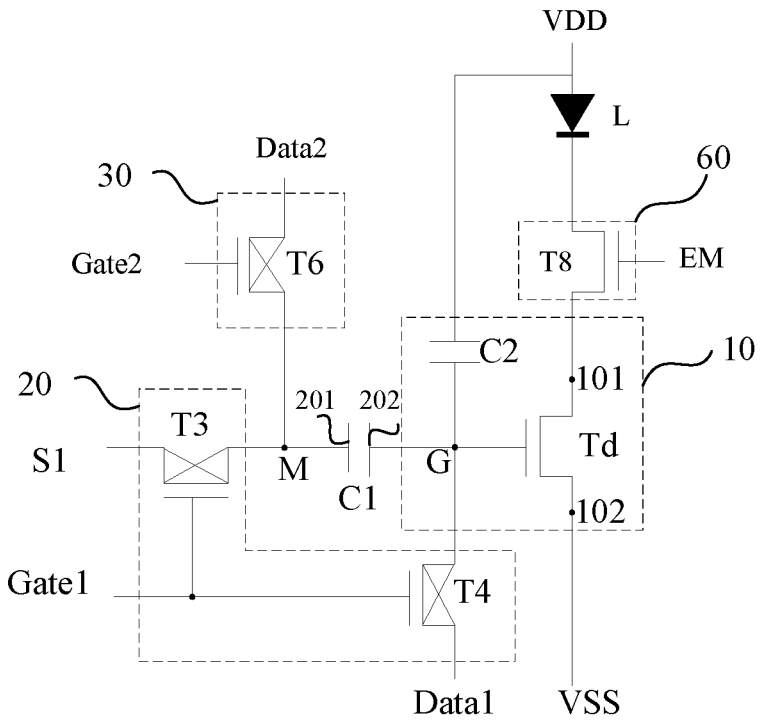
FIG. 8C is a stage diagram of another pixel circuit provided by some embodiments of the disclosure.

As shown in FIG. 8C, the light emission control terminal EM is input with a high level signal, at this point, the eighth transistor T8 and the driving transistor Td are both in an on state, and the third transistor T3, the fourth transistor T4 and the sixth transistor T6 are all in an off state.

In some other embodiments, as shown in FIG. 5, the pixel circuit further comprises a second reset sub-circuit 50, and the second reset sub-circuit 50 is configured to reset the second terminal of the element to be driven L in response to a third scanning signal provided by a third scanning terminal RST, so as to eliminate the influence of a signal of a previous frame on the second terminal.

Figure 9:
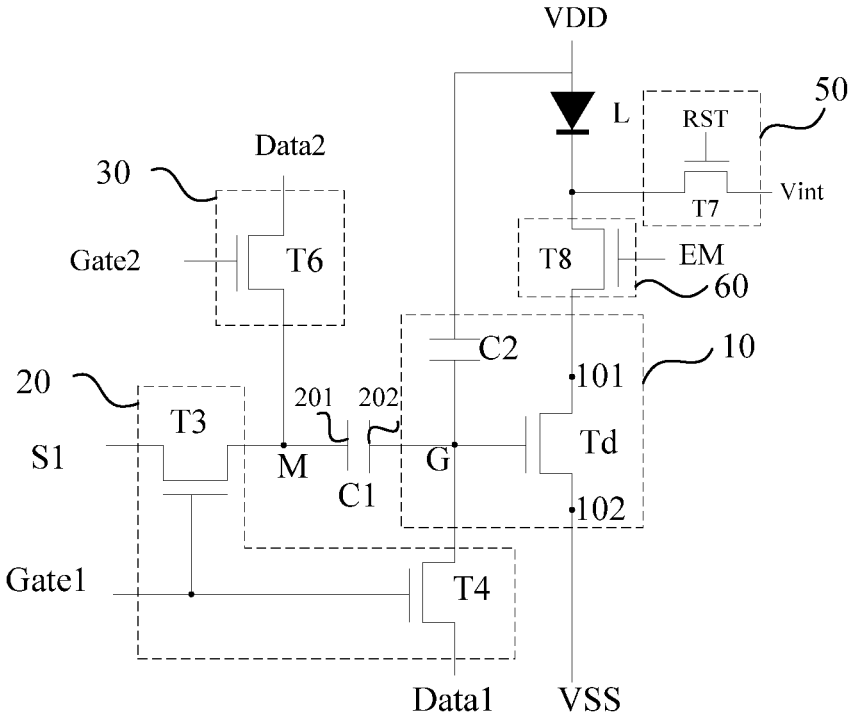
FIG. 9 is a diagram of another pixel circuit provided by some embodiments of the disclosure.

Specifically, as shown in FIG. 9, the second reset sub-circuit 50 comprises a seventh transistor T7, a grid of the seventh transistor T7 is coupled to the third scanning terminal RST providing the third scanning signal, a first pole is coupled to an initial signal terminal Vint providing an initial signal, and a second pole is coupled to the second terminal of the element to be driven L. After T7 is turned on, the initial signal provided by the initial signal terminal Vint may be input to the second terminal of the element to be driven L.

Figure 10:
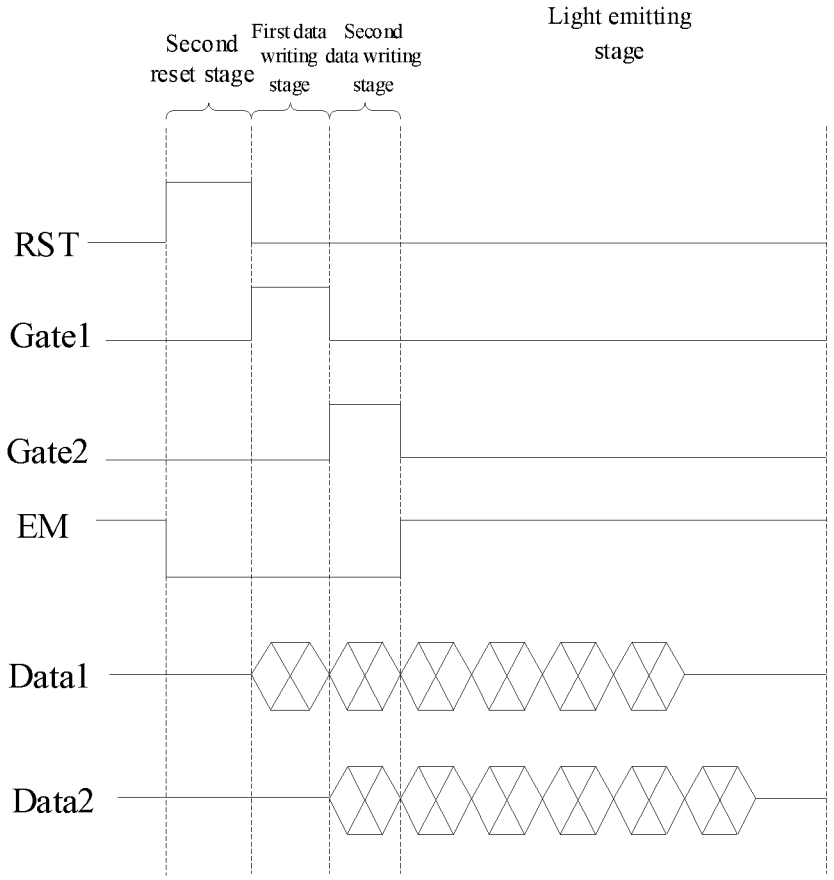
FIG. 10 is a timing diagram of another pixel circuit provided by some embodiments of the disclosure.

On this basis, with reference to the signal timing diagram shown in FIG. 10, the working principle of the pixel circuit shown in FIG. 9 will be illustrated in detail. When the pixel circuit comprises a second reset sub-circuit, the working principle of the pixel circuit may be divided into a reset stage, a first data writing stage, a second data writing stage, a driving stage and a light emitting stage. Each stage will be described below.

In the second reset stage, as shown in FIG. 10, since the third scanning signal from the third scanning terminal RST inputs a high level signal, the seventh transistor T7 is turned on, so that the third scanning signal from the third scanning terminal RST is input to the second terminal of the element to be driven L to reset the second terminal, thereby eliminating the influence of the signal of the previous frame on the second terminal.

Figure 11A:
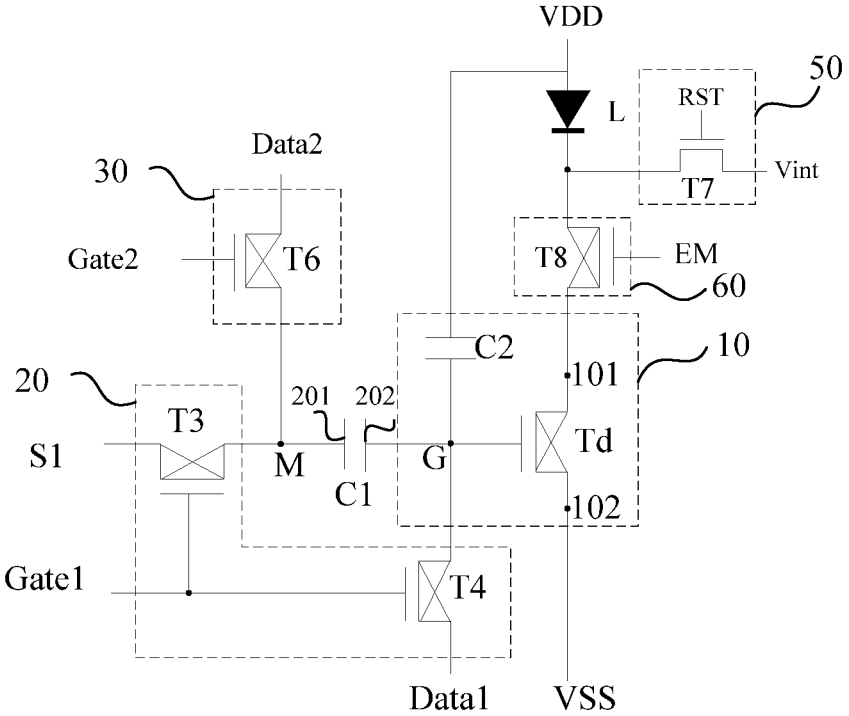
FIG. 11A is a stage diagram of another pixel circuit provided by some embodiments of the disclosure.

As shown in FIG. 11A, a high level signal is input to the third scanning terminal RST, at this point, the seventh transistor T7 is in an on state, and the third transistor T3, the fourth transistor T4, the sixth transistor T6, the driving transistor Td and the eighth transistor T8 are all in an off state.

In the first data writing stage, as shown in FIG. 10, because the first scanning signal from the first scanning terminal Gate1 inputs a high level signal, the third transistor T3 and the fourth transistor T4 are turned on.

Figure 11B:
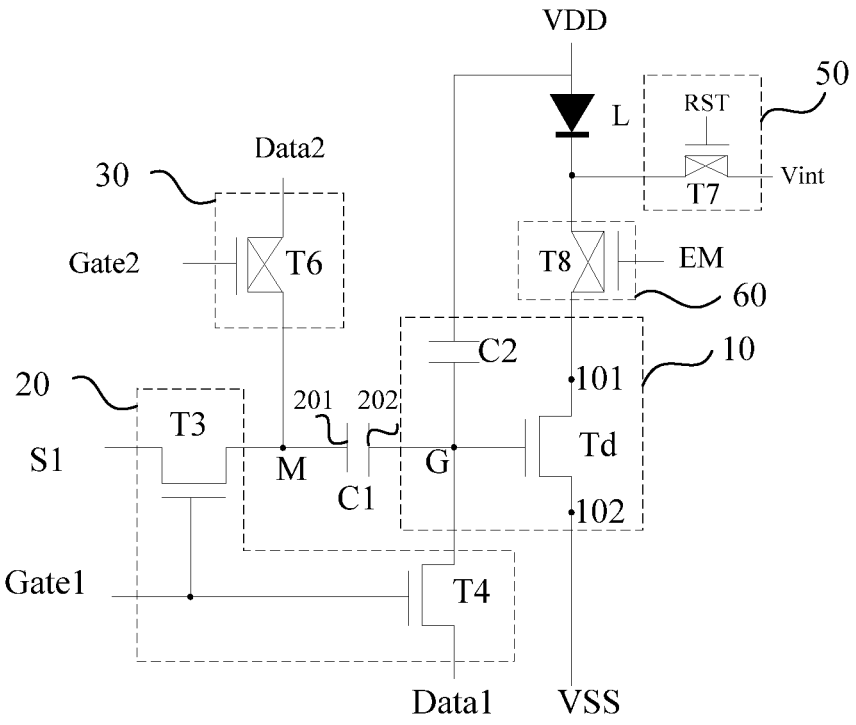
FIG. 11B is a stage diagram of another pixel circuit provided by some embodiments of the disclosure.

As shown in FIG. 11B, the first scanning terminal Gate1 is input with a high level signal, at this point, the third transistor T3, the fourth transistor T4 and the driving transistor Td are all in an on state, and the sixth transistor T6, the seventh transistor T7 and the eighth transistor T8 are all in an off state.

In the second data writing stage, as shown in FIG. 10, because the second scanning signal from the second scanning terminal Gate2 inputs a high level signal, the sixth transistor T6 is turned on.

Figure 11C:
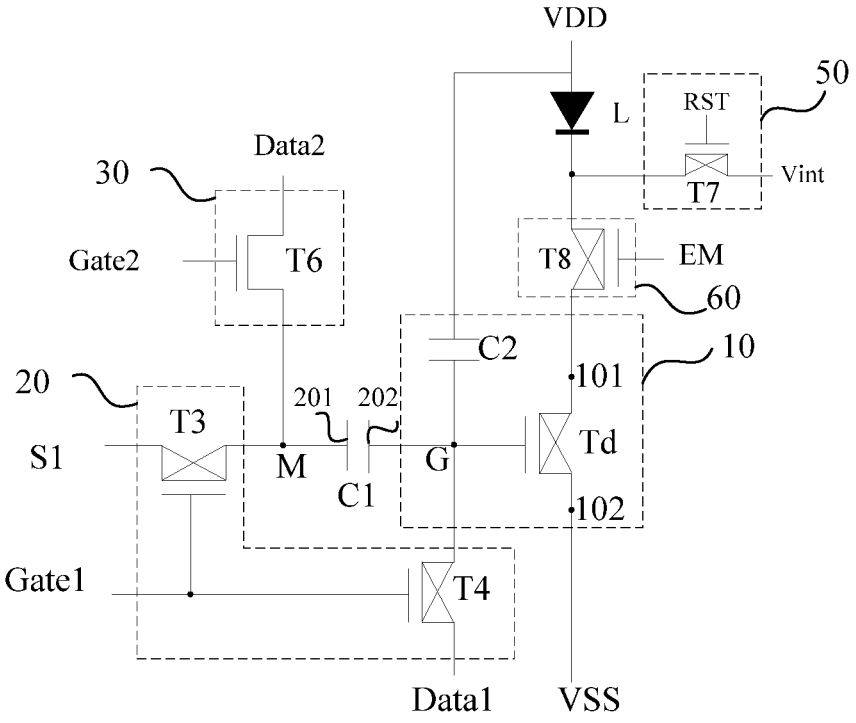
FIG. 11C is a stage diagram of another pixel circuit provided by some embodiments of the disclosure.

As shown in FIG. 11C, the second scanning terminal Gate2 is input with a high level signal, at this point, the sixth transistor T6 is in an on state, and the third transistor T3, the fourth transistor T4, the driving transistor Td, the seventh transistor T7, and the eighth transistor T8 are all in an off state.

For the explanation of the driving stage, please refer to the explanations in the above embodiments, which will not be repeated here.

In the light emitting stage, as shown in FIG. 10, because the light emission control signal from the light emission control terminal EM inputs a high level signal, the eighth transistor T8 is turned on.

Figure 11D:
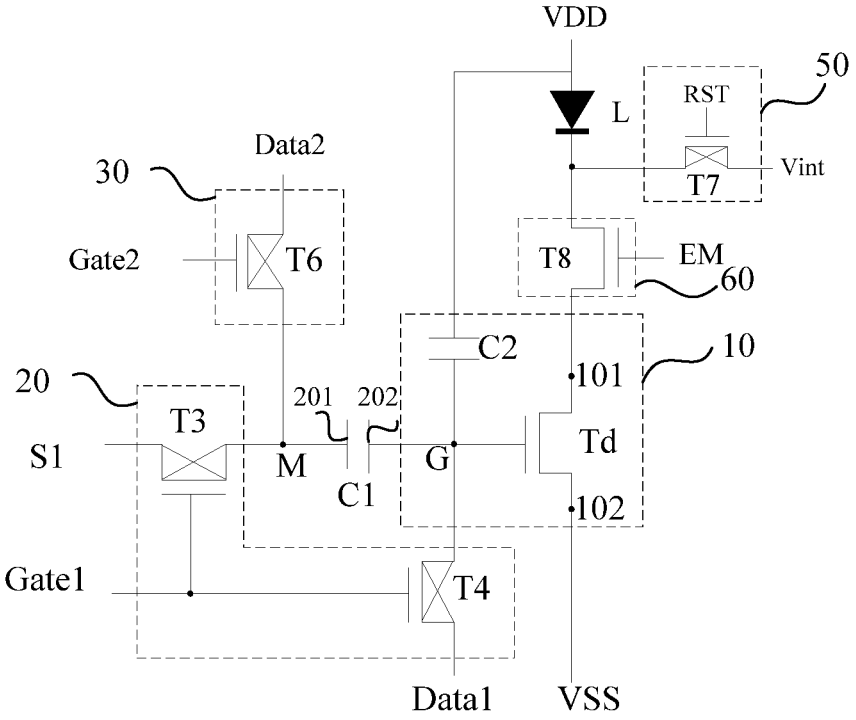
FIG. 11D is a stage diagram of another pixel circuit provided by some embodiments of the disclosure.

As shown in FIG. 11D, the light emission control terminal EM is input with a high level signal, at this point, the eighth transistor T8 and the driving transistor Td are both in an on state, and the third transistor T3, the fourth transistor T4, the sixth transistor T6 and the seventh transistor T7 are all in an off state.

In yet other embodiments, as shown in FIG. 5, the pixel circuit further comprises a first reset sub-circuit 40, a first transistor T1 included in the driving sub-circuit 10, a fifth transistor T5 included in the first data writing sub-circuit 10, and a ninth transistor T9 included in the light emission control sub-circuit 60.

The first reset sub-circuit 40 is configured to reset the control terminal G of the driving sub-circuit 10 in response to the third scanning signal provided by the third scanning terminal RST, so as to eliminate the influence of the previous frame on the control terminal G.

The driving sub-circuit 10 is further configured to connect the first terminal 101 of the driving sub-circuit with the control terminal G of the driving sub-circuit 10 in response to the first scanning signal provided by the first scanning end Gate1, so as to write a compensated first data signal to the control terminal G of the driving sub-circuit 10.

The first data writing sub-circuit 20 is coupled to the second terminal 102 of the driving sub-circuit 10 and configured to write the first data signal to the second terminal 102 of the driving sub-circuit 10.

Figure 12:
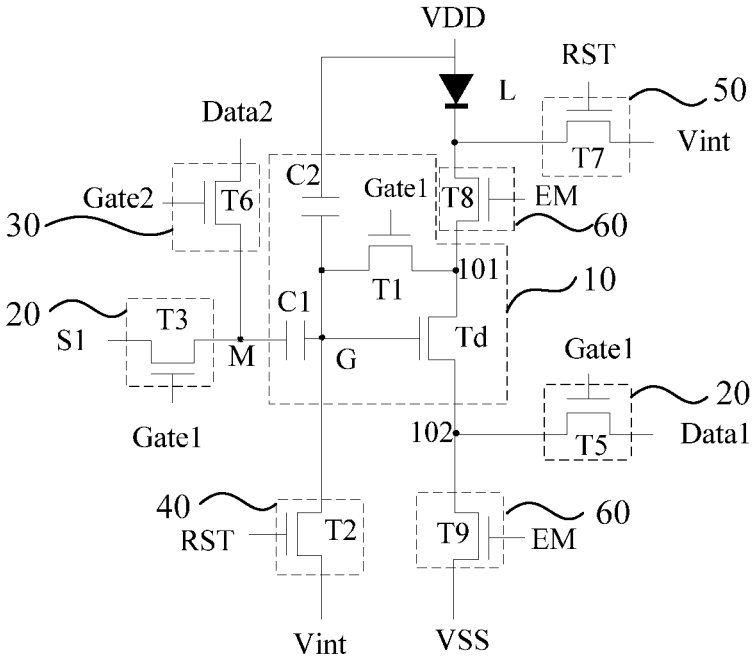
FIG. 12 is a diagram of another pixel circuit provided by some embodiments of the disclosure.

Specifically, as shown in FIG. 12, the first reset sub-circuit 40 comprises a second transistor T2, a grid of the second transistor T2 is coupled to the third scanning terminal RST providing the third scanning signal, a first pole is coupled to the initial signal terminal Vint providing the initial signal, and a second pole is coupled to the control terminal G of the driving sub-circuit 10. After T2 is turned on, the initial signal provided by the initial signal terminal Vint may be written into the control terminal G of the driving sub-circuit 10.

A grid of the first transistor T1 is coupled to the first scanning terminal Gate1 providing the first scanning signal, a first pole is coupled to the first terminal 101 of the driving sub-circuit, and a second pole is coupled to the control terminal G of the driving sub-circuit.

A grid of the fifth transistor T5 is coupled to the first scanning terminal Gate1 providing the first scanning signal, a first pole is coupled to the first data terminal Data1 providing the first data signal, and a second pole is coupled to the second terminal 102 of the driving sub-circuit 10. After T5 is turned on, the first data signal provided by the first data terminal Data1 may be written into the second terminal 102 of the driving sub-circuit 10.

A grid of the ninth transistor T9 is coupled to the light emission control terminal EM providing the light emission control signal, a first pole is coupled to the second terminal 102 of the driving sub-circuit 10, and a second pole is coupled to a second working voltage terminal VSS providing a second working voltage. After T9 is turned on, a second working circuit provided by the second working voltage terminal VSS may be written into the second terminal 102 of the driving sub-circuit 10.

Figure 13:
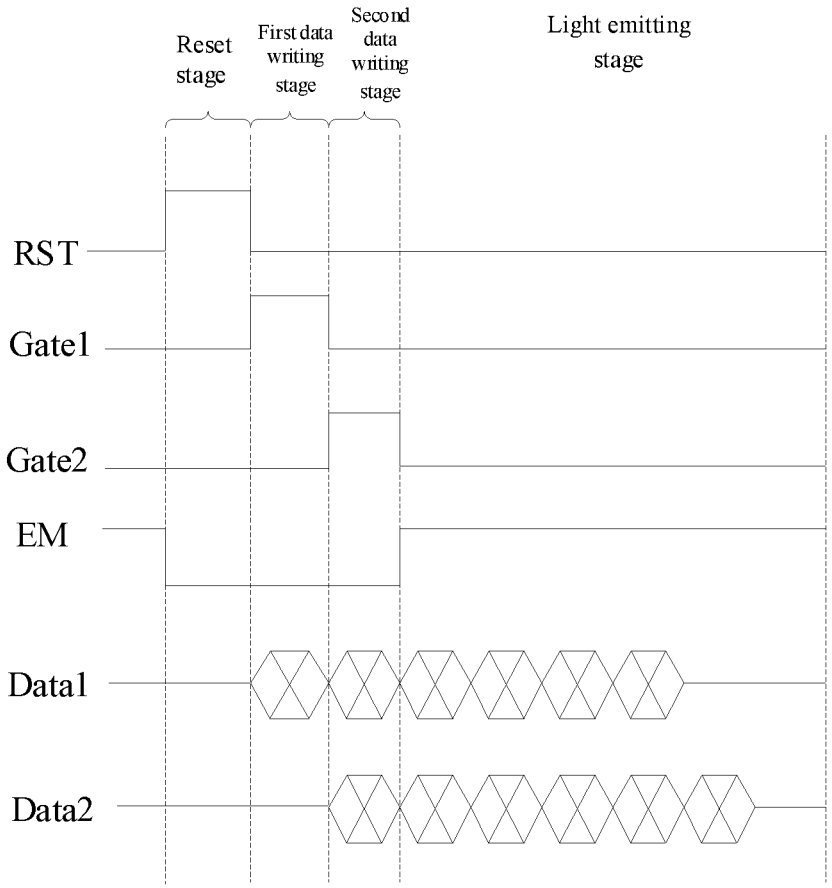
FIG. 13 is a timing diagram of another pixel circuit provided by some embodiments of the disclosure.

On this basis, with reference to the signal timing diagram shown in FIG. 13, the working principle of the pixel circuit shown in FIG. 12 will be illustrated in detail. When the pixel circuit comprises a first reset sub-circuit, the working principle of the pixel circuit may be divided into a reset stage, a first data writing stage, a second data writing stage, a driving stage and a light emitting stage. Each stage will be described below.

In the reset stage, as shown in FIG. 13, since the third scanning signal from the third scanning terminal RST inputs a high level signal, the second transistor T2 and the seventh transistor T7 are turned on, so that the third scanning signal from the third scanning terminal RST is input to the control terminal G of the driving sub-circuit 10 and the cathode of the light emitting component L to reset the control terminal G and the cathode of the light emitting component L, thereby eliminating the influence of the signal of the previous frame on the control terminal G and the cathode of the light emitting component L.

Figure 14A:
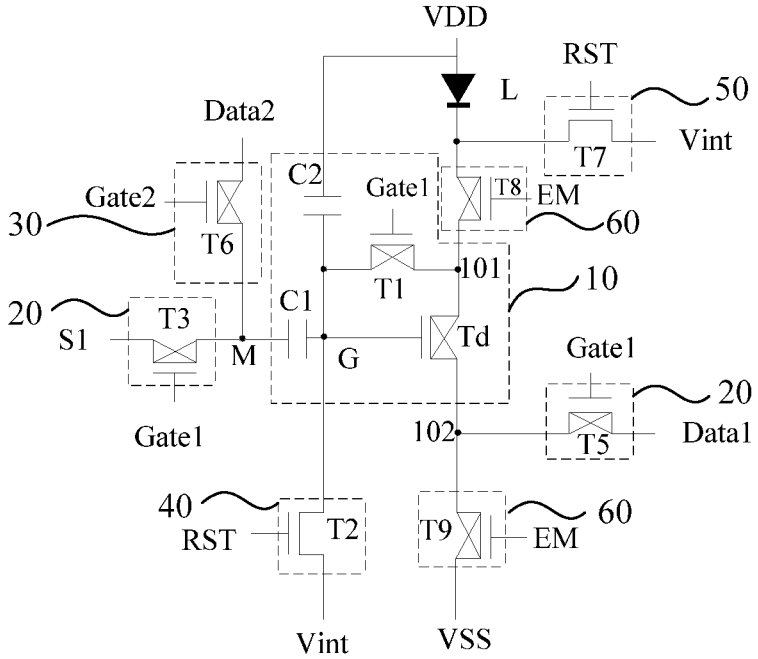
FIG. 14A is a stage diagram of another pixel circuit provided by some embodiments of the disclosure.

As shown in FIG. 14A, a high level signal is input to the third scanning terminal RST, at this point, the second transistor T2 and the seventh transistor T7 are both in an on state, and the first transistor T1, the third transistor T3, the fifth transistor T5, the sixth transistor T6, the eighth transistor T8 and the ninth transistor T9 are all in an off state.

In the first data writing stage, as shown in FIG. 13, since the first scanning signal from the first scanning terminal Gate1 inputs a high level signal, the first transistor T1, the third transistor T3 and the fifth transistor T5 are turned on, so that the first signal from the first signal terminal S1 is transmitted to the first pole of the first capacitor C1, that is, the first signal Vcom is transmitted to the node M, and the compensated first data signal is written into the control terminal G of the driving sub-circuit. At this point, the initial voltage at point M $V_M$=Vcom, and the initial voltage at point G $V_G=V_{Data1}+V_{th}$.

Figure 14B:
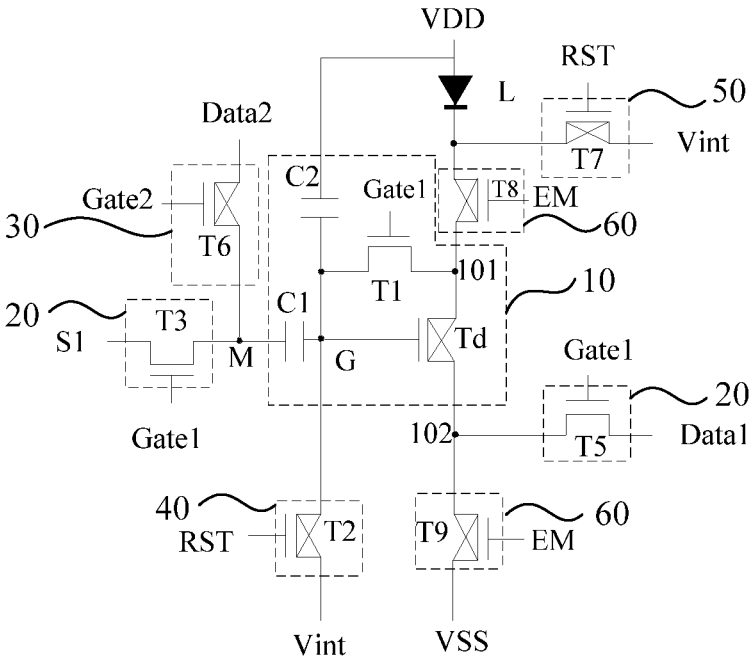
FIG. 14B is a stage diagram of another pixel circuit provided by some embodiments of the disclosure.

As shown in FIG. 14B, a high level signal is input to the first scanning terminal Gate1, at this point, the first transistor T1, the third transistor T3 and the fifth transistor T5 are all in an on state, and the second transistor T2, the sixth transistor T6, the seventh transistor T7, the eighth transistor T8, the ninth transistor T9 and the driving transistor Td are all in an off state.

In the second data writing stage, as shown in FIG. 13, because the second scanning signal from the second scanning terminal Gate2 inputs a high level signal, the sixth transistor T6 is turned on. At this point, the voltage at point M $V_M=V_{Data2}$, and according to the voltage holding characteristic of the capacitor, it may be concluded that a voltage of the control terminal G of the driving sub-circuit after jumping satisfies $V_G=V_{Data1}+V_{Data2}-Vcom+V_{th}$.

Figure 14C:
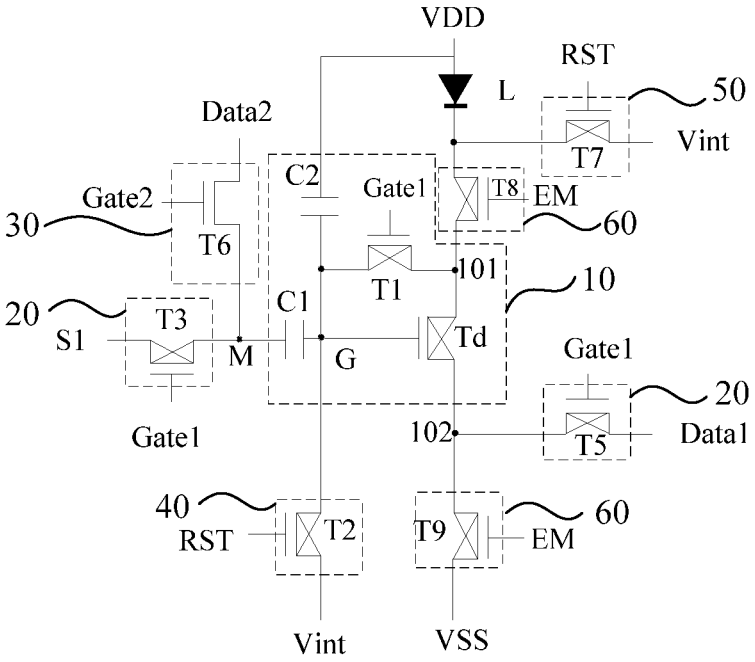
FIG. 14C is a stage diagram of another pixel circuit provided by some embodiments of the disclosure.

As shown in FIG. 14C, a high level signal is input to the second scanning terminal Gate2, at this point, the sixth transistor T6 is in an on state, and the first transistor T1, the second transistor T2, the third transistor T3, the fourth transistor T4, the fifth transistor T5, the driving transistor Td, the seventh transistor T7 and the eighth transistor T8 are all in an off state.

For the explanation of the driving stage, please refer to the explanations in the above embodiments, which will not be repeated here.

In this embodiment, the current driving the element to be driven L to emit light is $I=K*(V_G-V_S-V_{th})^2$, where $$K = \frac{1}{2} * \mu * Cox * \frac{W}{L},$$

μ is a migration rate of electrons, Cox is a gate oxide capacitance per unit area, $$\frac{W}{L}$$

is a width-length ratio of the driving transistor Td, and Vth is a threshold voltage.

$$V_{G'} = V_{Data1} + V_{Data2} - Vcom + V_{th} \quad \text{formula 1}$$

$$Vs = Vss \quad \text{formula 2}$$

where when Vcom=0, $V_{Data1}-V_{Data2}$, it may be calculated from the above formula 1 and formula 2 that the current flowing through the element to be driven L is $I=k*(2*V_{Data1}-Vss)^2$.

In the light emitting stage, as shown in FIG. 13, because the light emission control signal from the light emission control terminal EM inputs a high level signal, the eighth transistor T8 and the ninth transistor T9 are turned on.

Figure 14D:
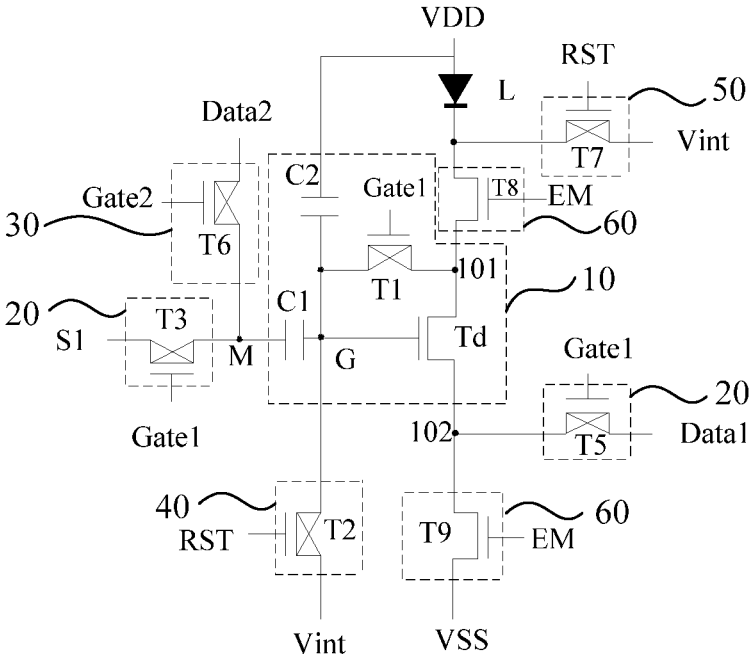
FIG. 14D is a stage diagram of another pixel circuit provided by some embodiments of the disclosure.

As shown in FIG. 14D, the light emission control terminal EM is input with a high level signal, at this point, the eighth transistor T8, the ninth transistor T9 and the driving transistor Td are all in an on state, and the first transistor T1, the second transistor T2, the third transistor T3, the fourth transistor T4, the fifth transistor T5, the sixth transistor T6 and the seventh transistor T7 are all in an off state.

According to the pixel circuit, the driving method thereof and the light emitting device provided by the embodiments of the disclosure, the first data writing sub-circuit is configured to write the first data signal to the first pole of the first capacitor and the driving sub-circuit in response to the first scanning signal, so that initial signals (such as data voltages) of the first capacitor and the driving sub-circuit may be obtained; the second data writing sub-circuit is configured to write the second data signal to the first pole of the first capacitor in response to the second scanning signal, so that a signal of the first pole of the first capacitor after the second data signal is written may be obtained; in this way, according to the voltage holding characteristic of the capacitor, the voltage of the control terminal of the driving sub-circuit will jump, for example, the voltage of the control terminal of the driving sub-circuit will increase, so that a data voltage required by a larger current may be provided to the light emitting component, and the display of corresponding brightness may be realized, thus improving the display effect.

Finally, it should be noted that the above embodiments are only used to illustrate the technical solutions of the disclosure, but not to limit the disclosure. Although the disclosure has been described in detail with reference to the foregoing embodiments, those of ordinary skill in the art should understand that the technical solutions described in the foregoing embodiments may still be modified, or some of the technical features may be equivalently replaced, and these modifications or substitutions do not make the essence of the corresponding technical solutions deviate from the spirit and scope of the technical solutions of the embodiments of the disclosure.

The invention claimed is:

1. A pixel circuit for providing a driving signal to an element to be driven, comprising:

a driving sub-circuit comprising a control terminal, a first terminal and a second terminal, the driving sub-circuit being configured to control the driving signal flowing through the first terminal and the second terminal according to a signal of the control terminal;

a first capacitor comprising a first pole and a second pole, the second pole being coupled to the control terminal of the driving sub-circuit;

a first data writing sub-circuit configured to write a first initialization signal to the first pole of the first capacitor in response to a first scanning signal, and write a first data signal into the driving sub-circuit in response to the first scanning signal, so that the signal of the control signal of the driving sub-circuit changes with the first data signal;

a second data writing sub-circuit configured to write a second data signal to the first pole of the first capacitor in response to a second scanning signal, so that the signal of the control terminal of the driving sub-circuit jumps;

the first data writing sub-circuit is coupled to the control terminal of the driving sub-circuit and configured to write the first data signal to the control terminal of the driving sub-circuit;

the first data writing sub-circuit is coupled to the second terminal of the driving sub-circuit and configured to write the first data signal to the second terminal of the driving sub-circuit; and the driving sub-circuit is further configured to connect the first terminal of the driving sub-circuit with the control terminal of the driving sub-circuit in response to the first scanning signal so as to write a compensated first data signal to the control terminal of the driving sub-circuit.

2. The pixel circuit according to claim 1, wherein the driving sub-circuit further comprises a first transistor; and a grid of the first transistor is coupled to a first scanning terminal providing the first scanning signal, a first pole is coupled to the first terminal of the driving sub-circuit, and a second pole is coupled to the control terminal of the driving sub-circuit.

3. The pixel circuit according to claim 1, wherein the pixel circuit further comprises:

a first reset sub-circuit configured to reset the control terminal of the driving sub-circuit in response to a third scanning signal.

4. The pixel circuit according to claim 3, wherein the first reset sub-circuit comprises a second transistor; and a grid of the second transistor is coupled to a third scanning terminal providing the third scanning signal, a second pole is coupled to the control terminal of the driving sub-circuit, and a first pole is coupled to an initial signal terminal.

5. The pixel circuit according to claim 1, wherein the first data writing sub-circuit comprises a third transistor and a fourth transistor;

a grid of the third transistor is coupled to a first scanning terminal providing the first scanning signal, a first pole is coupled to a first signal terminal, and a second pole is coupled to the first pole of the first capacitor;

a grid of the fourth transistor is coupled to the first scanning terminal providing the first scanning signal, a first pole is coupled to a first data terminal providing the first data signal, and a second pole is coupled to the control terminal of the driving sub-circuit.

6. The pixel circuit according to claim 1 wherein the first data writing sub-circuit comprises a third transistor and a fifth transistor;

a grid of the third transistor is coupled to a first scanning terminal providing the first scanning signal, a first pole is coupled to a first signal terminal, and a second pole is coupled to the first pole of the first capacitor;

a grid of the fifth transistor is coupled to the first scanning terminal providing the first scanning signal, a first pole is coupled to the first data terminal providing the first data signal, a second pole is coupled to the second terminal of the driving sub-circuit.

7. The pixel circuit according to claim 1, wherein the second data writing sub-circuit comprises a sixth transistor, and a grid of the sixth transistor is coupled to a second scanning terminal providing the second scanning signal, a first pole is coupled to a second data terminal providing the second data signal, and a second pole is coupled to the first pole of the first capacitor.

8. The pixel circuit according to claim 1, wherein the pixel circuit further comprises:

a second reset sub-circuit configured to reset a second terminal of the element to be driven in response to a third scanning signal.

9. The pixel circuit according to claim 8, wherein the second reset sub-circuit comprises a seventh transistor; and a grid of the seventh transistor is coupled to a third scanning terminal providing the third scanning signal, a first pole is coupled to the initial signal terminal, and a second pole is coupled to a second terminal of the element to be driven.

10. The pixel circuit according to claim 1, wherein the pixel circuit further comprises:

a light emission control sub-circuit configured to apply a voltage of a first working voltage terminal to the first terminal of the driving sub-circuit in response to a light emission control signal to control a driving signal applied to the element to be driven.

11. The pixel circuit according to claim 10, wherein the light emission control sub-circuit comprises an eighth transistor and/or a ninth transistor;

a grid of the eighth transistor is coupled to a light emission control terminal providing the light emission control signal, a first pole is coupled to a second terminal of the element to be driven, and a second pole is coupled to the first terminal of the driving sub-circuit; and a grid of the ninth transistor is coupled to the light emission control terminal providing the light emission control signal, a first pole is coupled to the second terminal of the driving sub-circuit, and a second pole is coupled to a second working voltage terminal providing a second working voltage.

12. Electronic device comprising the pixel circuit according to claim 1 and an element to be driven coupled to the pixel circuit.

13. The electronic device according to claim 12, wherein the first data writing sub-circuit is coupled to the control terminal of the driving sub-circuit and configured to write the first data signal to the control terminal of the driving sub-circuit.

14. A driving method of the pixel circuit according to claim 1, wherein the pixel circuit is used for providing a driving signal to an element to be driven, and the driving method of the pixel circuit comprises:

writing, by the first data writing sub-circuit, a first initialization signal to a first pole of the first capacitor and a first data signal to the driving sub-circuit in response to a first scanning signal;

writing, by the second data writing sub-circuit, a second data signal to the first pole of the first capacitor in response to a second scanning signal, so that a signal of the control signal of the driving sub-circuit jumps; and controlling, by the driving sub-circuit, a driving signal flowing through the first terminal and the second terminal according to the signal of the control terminal.

15. The driving method of the pixel circuit according to claim 14, wherein the pixel circuit further comprises a first reset sub-circuit and/or a second reset sub-circuit; and before writing, by the first data writing sub-circuit, a first initialization signal to a first pole of the first capacitor and a first data signal to the driving sub-circuit in response to a first scanning signal, the driving method of the pixel circuit further comprises:

resetting, by the first reset sub-circuit, the control terminal of the driving sub-circuit;

and/or, resetting, by the second reset sub-circuit, the second terminal of the element to be driven.

16. The driving method of the pixel circuit according to claim 14, wherein the pixel circuit further comprises a light emission control sub-circuit; and the driving method of the pixel circuit further comprises:

applying, by the light emission control sub-circuit, a voltage of a first working voltage terminal to the first terminal of the driving sub-circuit in response to a light emission control signal, so that the driving sub-circuit controls the driving signal flowing through the first terminal and the second terminal according to the signal of the control terminal.

* * * * *